US005505394A

United States Patent [19]

Kudrus

[11] Patent Number: 5,505,394

[45] Date of Patent: Apr. 9, 1996

[54] DEVICE FOR WINDING THREADS ON SPOOL, WITH GUIDING ROLLER AND TWO ROTORS

[75] Inventor: Heiner Kudrus, Barmstedt, Germany

[73] Assignee: Neumag-Neumuenstersche Maschinen-und Anlagenbau GmbH, Neumuenster, Germany

[21] Appl. No.: 238,714

[22] Filed: May 5, 1994

[30] Foreign Application Priority Data

May 21, 1993 [DE] Germany ..... 43 17 087.0

[51] Int. Cl.[6] ..... B65H 54/28; B65H 57/28

[52] U.S. Cl. ..... 242/43 A; 242/158.1

[58] Field of Search ..... 242/43 A, 158.1

[56] References Cited

U.S. PATENT DOCUMENTS 4,561,603 12/1985 Schippers et al. ..... 242/43 A

FOREIGN PATENT DOCUMENTS 114642 8/1984 European Pat. Off. ..... 242/43 A 3703731 8/1987 Germany ..... 242/43 A 3826130 2/1989 Germany ..... 242/43 A 1099963 1/1968 United Kingdom ..... 242/43 A

*Primary Examiner*—William Stryjewski

*Attorney, Agent, or Firm*—Michael J. Striker

[57] ABSTRACT

A device for winding threads on a spool, comprises a spool spindle, a guiding roller, and a changing unit including two rotors driven in opposite direction and each provided with at least two propeller-like wings, the rotors having axes located with a small distance parallel near one another, the rotors being rotatable in rotary planes in which the wings of the rotors rotate and which are spaced from one another by a small distance d, the changing unit being formed so that a thread running at end points of the changing region forms with the rotary planes an acute angle $\alpha$, the rotors being arranged so that an axis of one of the rotors whose wings rotate in a rotary plane spaced farther from the guiding roller is offset back in direction perpendicular to an axis of the guiding roller by the magnitude $a=d\cdot\cot\alpha$ relative to the axis of the other of the rollers.

2 Claims, 4 Drawing Sheets

DEVICE FOR WINDING THREADS ON SPOOL, WITH GUIDING ROLLER AND TWO ROTORS

BACKGROUND OF THE INVENTION

The present invention relates generally to a device for winding threads.

More particularly, it relates to a device for winding threads which has a spool spindle, a guide roll and a changing unit with two oppositely driven rotors having at least two propeller-like wings.

Devices of the above mentioned general type are known in the art. Wing changing devices are suitable especially for the use with high changing frequencies. In contrast to the conventional changing devices, the alternative movement of the thread is performed not by a single reciprocating thread guide, but instead by oppositely rotating wings which alternatingly engage and guide the threads. Since the wings at the end points of the changing region neither accelerate nor retarded the influence of the carrier mass of the thread guiding element during the thread reverse is completely eliminated.

The oppositely moving wings of both rotors meet at predetermined fixed meeting points. The meeting points are distributed with uniform angular distances over a rotary circle. The angular distances depend on the number of wings of a rotor. When a rotor has for example two wings, it amounts to 90 degree. The changing takes place between two neighboring meeting points. The wing which is located correspondingly in the region of this quarter circular arc leads the thread. When it reaches the meeting point, it is transmitted to the oppositely coming wing of the other rotor. After this angle of exactly 90 degree is covered, the thread is taken up by the second wing of the first rotor, etc. For a disturbance free winding and an unobjectionable spool formation, especially at the end surfaces, an exact thread transfer to the end points of the changing region is important.

In known spooling machines the both rotors of the wing changing device are offset relative to one another so that the axis of one rotor is displaced in direction of the changing stroke, or in other words parallel to the coil axis. Thereby the transfer of the thread from one wing of one rotor to the oppositely coming wing of the other rotor is facilitated. At both meeting points which mark the end points of the changing region, the corresponding receiving wing extends outwardly beyond the rotary circle of the transmitting wing. The preceding wing end takes the thread which is transmitted from the wing tip of the transmitting wing, as disclosed in the German document DE-OS 33 07 915.

The European patent document EP-A1-0 322 752 discloses a spooling machine in which two rotors are arranged coaxially relative to one another. Additional guiding elements are provided for exact thread transfer at the ends of the changing region.

In the known spooling machines the changing device is arranged with multiple inclinations, so that between the rotary planes of the wings and an incoming thread an acute angle is provided. Due to the inclined position, the thread length between the changing wings and the guiding rollers arranged behind them can be retained very small. This feature is important for an exact thread guidance. Due to the inclined position the rotary circle of the wing which rotates in the rotary plane spaced further from the guiding roller, extends a little beyond the rotary circle of the wing of the other roller. At the end point of the changing region, at which one of the first mentioned wings takes the thread, this wing is in contact with the thread a little bit too early. At the other end it transfers the thread a little bit too late.

These disturbing effect can be counteracted by forming and arranging the guiding arm differently at both reversing points. This is however expensive and difficult to reproduce. Also, during optimal adjustment it has been observed that at both end surfaces of the coil a different coil formation is produced because of the different constellation of the wings and a different movement course during the thread transfer.

SUMMARY OF THE INVENTION

Accordingly, it is an object of the present invention to provide a device of the above mentioned general type, which avoids the disadvantages of the prior art.

More particularly, it is an object of the present invention to provide a device for winding threads in which the wing constellation and the movement course at both end points of the changing device are comparable with one another.

In keeping with these objects and with others which will become apparent hereinafter, one feature of the present invention resides, briefly stated, in a device for winding thread on a spool in which the axis of the rotor whose wing rotates in the rotary plane farther spaced from the guiding roller is offset back in direction perpendicular to the axis of the guiding roller by the magnitude $a=d\cdot\cot\alpha$ relative to the axis of the other roller.

When the device is designed in accordance with the present invention, the rotary axes of the rotors are arranged so that exactly at the time point in which the wing at the end of the changing stroke has reached the corresponding angular position, the transmitting wing lowers behind the thread guiding surface and the receiving wing raises from this plane. Thereby an identical good spool formation is obtained at both end sides of the spool.

In accordance with another feature of the present invention, preferably the axes of both rollers are additionally offset in direction parallel to the axis of the guiding roller. Therefore, in a known manner, a reliable thread transfer is guaranteed without additional guiding elements.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
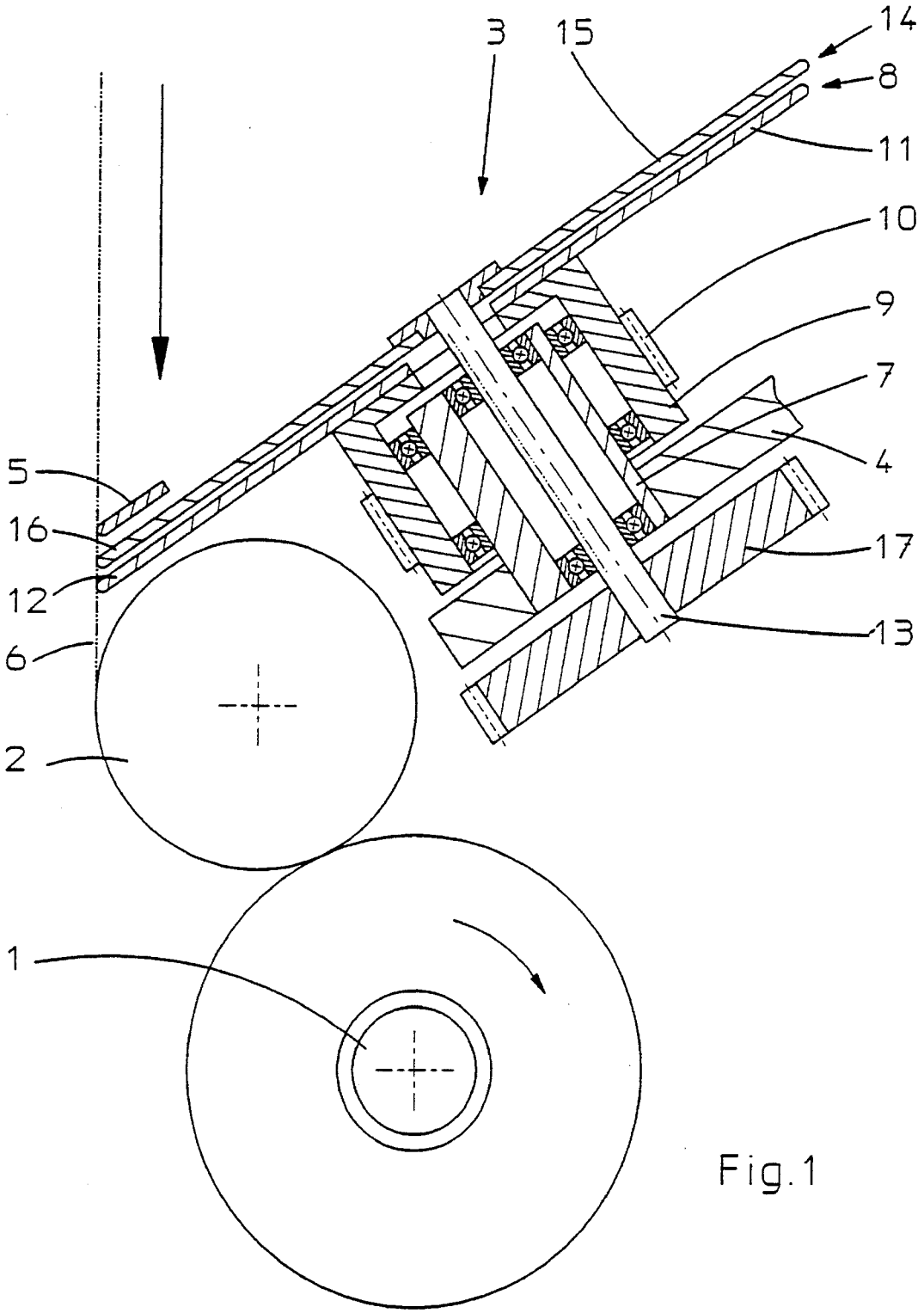
FIG. 1 is a view showing a section of a device for winding threads in accordance with the present invention.

A device for winding thread in accordance with the present invention has a spool spindle 1 and a guiding roller 2 which are connected with the machine frame in a known manner. A changing device 3 is mounted with a holding plate 4 on the not shown machine frame. A guiding arm 5 for threads 6 coming vertically from above is associated with the changing device 3.

The holding plate 4 carries an eccentric bushing 7. A rotor 8 is mounted on the outer surface of the bushing. It has a ring-shaped base body 9, a toothed rim 10 on which the base body 9 is located, and two propeller shaped wings 11 and 12. The eccentric bushing 7 has an opening with an axis which is displaced parallel to the axis of the outer surface. The distance between both axes is identified as the eccentricity e in FIG. 2. A shaft 13 of another rotor 14 is supported in the opening. One end of the shaft 13 extends beyond the plane in which the vanes 11 and 12 are arranged. At this end two propeller-shaped wings 15 and 16 are mounted. The wings 15 and 16 are mirror-inverted with respect to the wings 11 and 12. The other end of the shaft 13 carries a toothed disc 17. The toothed rim 10 and the toothed disc 17 are drivable by a not shown toothed belt. They are coupled through a transmission so that they rotates with the same rotary speed but in opposite directions.

The rotary circle of the wing pairs 11, 12; 15, 16 of both rotors 8, 14 extends through the thread running plane or in other words the plane which is intersected by the thread during the changing movement. In the embodiment shown in FIGS. 1—3 the rotary circle extends between the guiding arm 5 and the guiding roller 2. A narrow distance d is provided between the rotary planes in which the wings 11, 12; 15, 16 rotate, as measured from the center to the center in FIG. 3. The changing device 3 is arranged inclinedly, so that the thread running surface which is slightly curved due to the curvature of the guiding arm 5 shown in FIG. 2 forms with both rotary planes at the end points of the changing region an acute angle $\alpha$. As a rule, this angle $\alpha$ is equal to between 40 and 75 degree, and in the shown example, it is between 50 and 60 degree.

Figure 2:
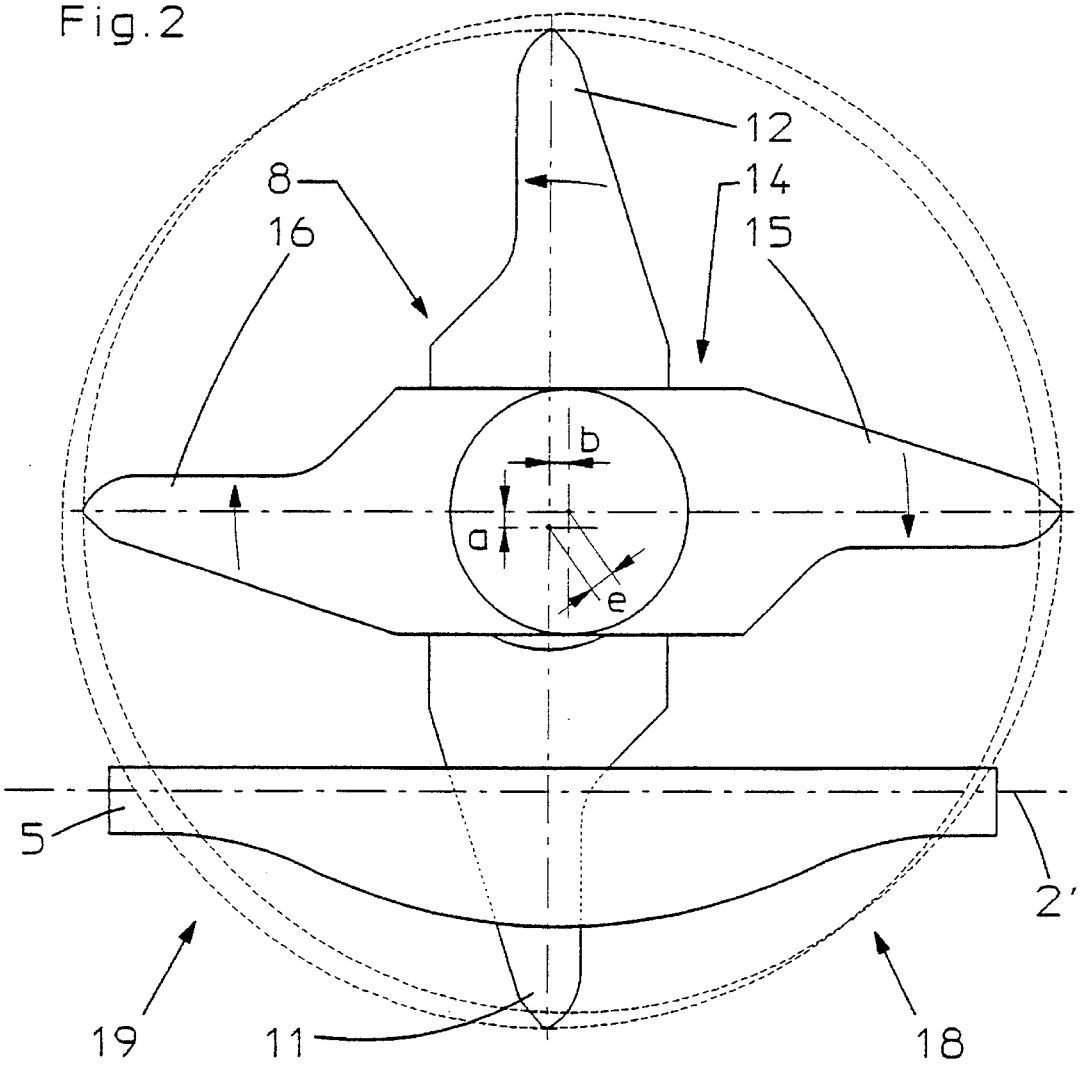
FIG. 2 is a view showing two rotors of the device in direction of the axes of the rotors.

As can be seen from FIG. 2, the axis of the rotor 14 is offset relative to the axis of the rotor 8 in direction of the guiding arm 5, or in other words, in direction parallel to the axis 2' of the guiding roller 2, by a distance b and perpendicularly to it by the distance a. Thereby the eccentricity e is produced.

Figure 3:
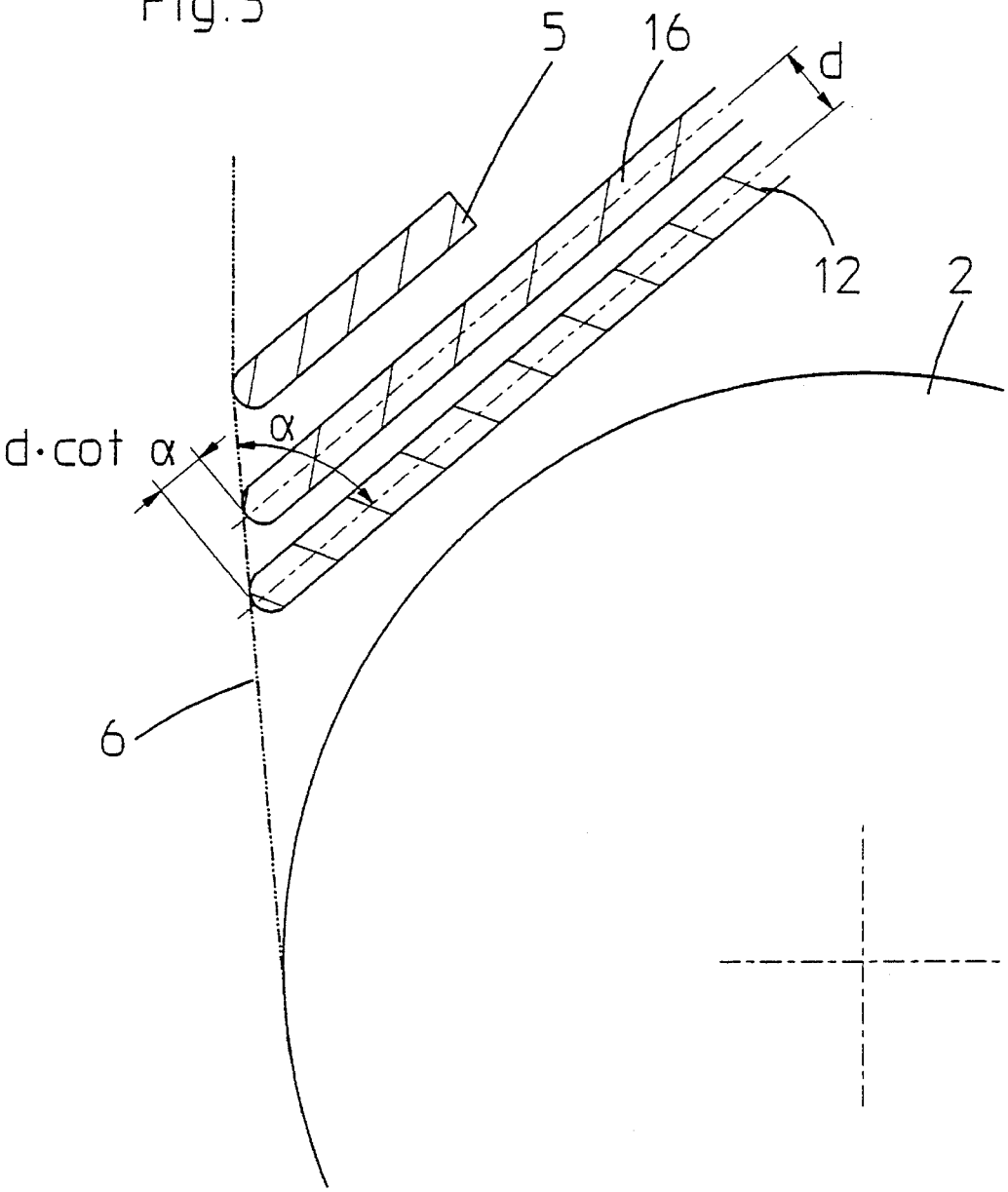
FIG. 3 is a view showing a fragment of FIG. 1 on an enlarged scale.

Due to the offset a which in FIG. 3 shows an instantaneous position of the device in the moment of the thread transfer, the tip of both vanes 12, 16 exactly contact the thread running surface which in FIG. 3 is shown with the same line as the thread 6. One of the wings, for example the wing 16, is lowered in this moment straight under the thread running surface. The other wing, in this case the wing 12, simultaneously raises above the thread running surface and takes up the thread guidance. The wing 12 is withdrawn exactly by 90 degree, starting from the time point in which it takes up the thread to the time point in which the wing 15 which is angularly offset relative to the wing 16 by 180 degree takes up the thread. The same is true for the subsequent opposite stroke. The offset a compensates exactly the above described disturbing effect caused by the inclined position. This is achieved in particular when the following equation is maintained:

$$a=d\cdot\cot\alpha$$

The offset b is independent from the inclined position and in conventional manner serves for facilitating the thread transfer.

Figure 4:
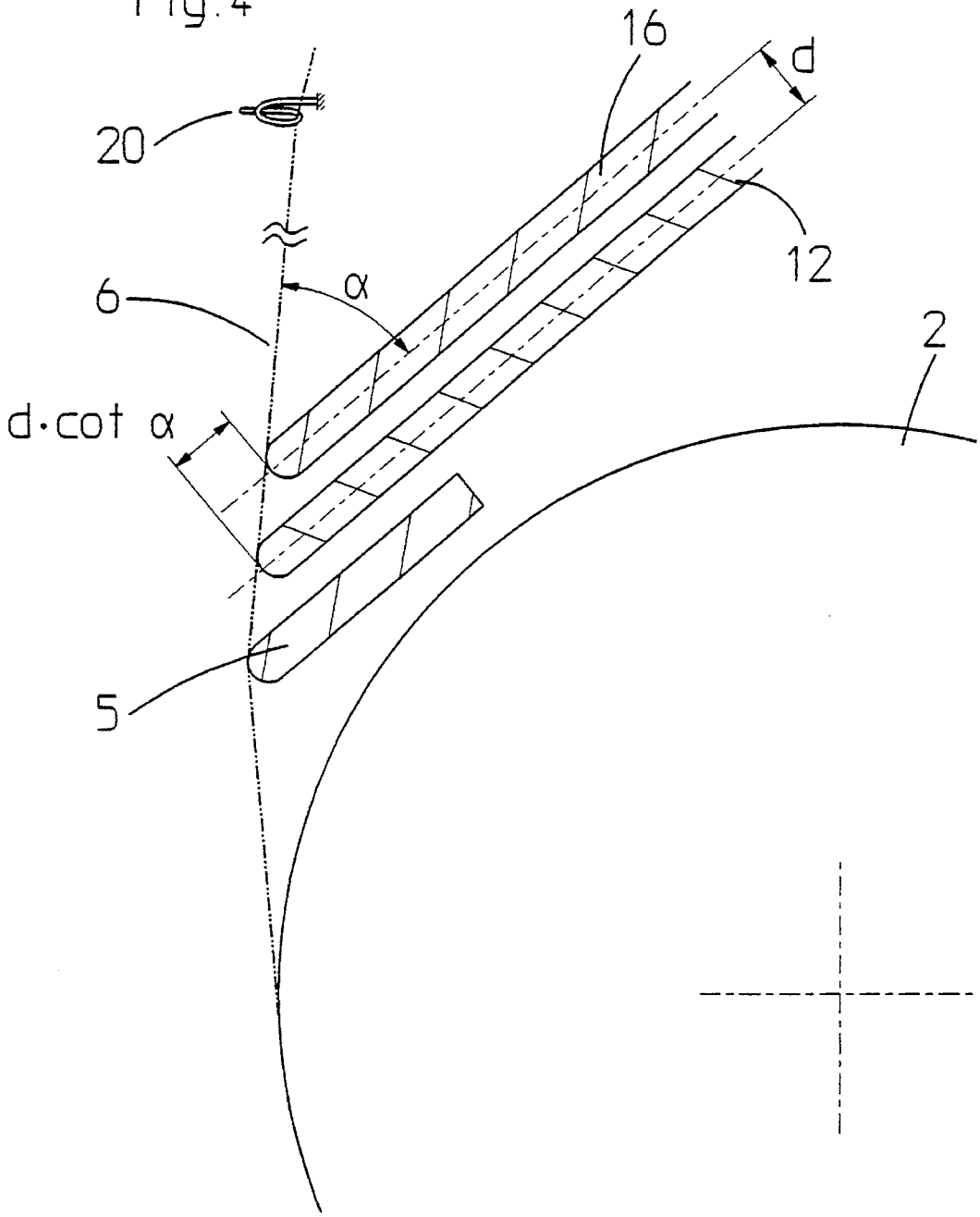
FIG. 4 is a view substantially analogous to the view of FIG. 3 but showing the fragment in accordance with another embodiment of the invention.

The device in accordance with the embodiment of FIG. 4 differs from the above described embodiment in that the guiding arm 5 is arranged between the rotary planes of both rotor wing pairs on the one hand, and the guiding roller 2 on the other hand. Therefore the rotary circle of the wing pairs 11, 12; 15, 16 intersects a part of the thread running surface located between a stationary thread guiding ear 20 and the guiding arm 5.

It will be understood that each of the elements described above, or two or more together, may also find a useful application in other types of constructions differing from the types described above.

While the invention has been illustrated and described as embodied in a device for winding threads, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for winding threads on a spool, comprising a spool spindle; a guiding roller; and a changing unit including two rotors driven in opposite direction and each provided with at least two propeller-like wings, said rotors having axes located with a small distance parallel near one another, said rotors being rotatable in rotary planes in which said wings of said rotors rotate and which are spaced from one another by a small distance d, said changing unit being formed so that a thread running at end points of a changing region forms with said rotary planes an acute angle $\alpha$, said rotors being arranged so that an axis of one of said rotors whose wings rotate in a rotary plane spaced farther from said guiding roller is offset back in direction perpendicular to an axis of said guiding roller by the magnitude $a=d\cdot\cot\alpha$ relative to the axis of the other of said rotors.

2. A device as defined in claim 1, wherein said axis of said rotors are offset additionally in direction parallel to said axis of said guiding roller.

* * * * *